US009722314B2

(12) United States Patent
Matsumura et al.

(10) Patent No.: US 9,722,314 B2
(45) Date of Patent: Aug. 1, 2017

(54) PATCH ANTENNA

(71) Applicant: FUJITSU LIMITED, Kawasaki-shi, Kanagawa (JP)

(72) Inventors: Hiroshi Matsumura, Isehara (JP); Yoichi Kawano, Setagaya (JP)

(73) Assignee: FUJITSU LIMITED, Kawasaki (JP)

( * ) Notice: Subject to any disclaimer, the term of this patent is extended or adjusted under 35 U.S.C. 154(b) by 213 days.

(21) Appl. No.: 14/922,541

(22) Filed: Oct. 26, 2015

(65) Prior Publication Data

US 2016/0149307 A1 May 26, 2016

(30) Foreign Application Priority Data

Nov. 26, 2014 (JP) ..... 2014-239015

(51) Int. Cl.
*H01Q 9/04* (2006.01)
*H01Q 5/364* (2015.01)

(52) U.S. Cl.
CPC ..... *H01Q 9/0442* (2013.01); *H01Q 5/364* (2015.01)

(58) Field of Classification Search
CPC ..... H01Q 9/0442; H01Q 5/364
USPC ..... 343/700 MS
See application file for complete search history.

(56) References Cited

U.S. PATENT DOCUMENTS

| | | | | |
|---|---|---|---|---|
| 5,410,323 | A | 4/1995 | Kuroda | |
| 2002/0089452 | A1* | 7/2002 | Lovestead | H01Q 9/0407 343/700 MS |
| 2005/0162318 | A1 | 7/2005 | Higasa | |
| 2009/0140942 | A1* | 6/2009 | Mikkola | H01Q 1/243 343/767 |
| 2009/0273528 | A1* | 11/2009 | Rudant | H01Q 1/38 343/725 |

FOREIGN PATENT DOCUMENTS

| | | |
|---|---|---|
| JP | H05-304413 | 11/1993 |
| JP | 2005-203873 A1 | 7/2005 |
| JP | 2005-252585 A1 | 9/2005 |

* cited by examiner

*Primary Examiner* — Dameon E Levi
*Assistant Examiner* — Andrea Lindgren Baltzell
(74) *Attorney, Agent, or Firm* — Katz, Quintos & Hanson, LLP

(57) ABSTRACT

A patch antenna includes: a substrate configured with a dielectric material; a ground electrode formed on one side surface of the substrate; and a radiation electrode having a rectangular shape formed on another side surface of the substrate, wherein a slit is formed in the radiation electrode in parallel to a first side of the radiation electrode to be shorter than the first side, and each of a gap between the slit and the first side and a gap between the slit and a second side facing the first side is shorter than the first side.

7 Claims, 7 Drawing Sheets

PATCH ANTENNA

CROSS-REFERENCE TO RELATED APPLICATIONS

This application is based upon and claims the benefit of priority of the prior Japanese Patent Application No. 2014-239015 filed on Nov. 26, 2014, the entire contents of which are incorporated herein by reference.

FIELD

The embodiments discussed herein are related to, for example, a patch antenna.

BACKGROUND

A microstrip antenna called a patch antenna where one side surface of a dielectric substrate is covered with a ground electrode and the other side surface of the dielectric substrate is provided with a rectangular or circular radiation electrode, has been known. The patch antenna may be made thin and has a high gain, and thus is being used in various applications.

In the patch antenna, there is suggested a technology of forming a cutout in a radiation electrode to adjust a property of the antenna.

For example, eight slit-like cutouts are formed in a radiation conductor formed in a square shape of a planar antenna. These slit-like cutouts are formed in a parallel direction with respect to an arbitrary side from the respective sides of the radiation conductor and at positions where the radiation conductor has the same shape even if rotated by 90°. Accordingly, an impedance change with respect to a distance change from an origin to a feeding point becomes relatively small so that an impedance matching is easily performed with the planar antenna, and at the same time, the planar antenna has a wide bandwidth.

For example, a radiation electrode is formed to have an external shape having cutout portions at four positions of a patch antenna, and each cutout portion is formed at a position facing a substantial center of four sides of a dielectric substrate. Then, since the patch antenna has the cutout portions, a downward radiation is suppressed to increase a gain in a zenith direction.

For example, a leg side extends from a cutout portion formed at the center of each side of a substantially squared radiation conductor plate of a circularly polarized wave antenna. A gap between opposed leg sides is set to be longer than a gap between opposed leg sides at the other side by a predetermined length. It is set that a diagonal line on which a feeding pin is present has an angle of 45° with respect to a straight line A having one side opposed leg sides present at both ends, and a straight line B having the other side opposed leg sides present at both ends. Accordingly, since a prescribed difference occurs in a resonance length between a resonance mode along the straight line A and a resonance mode along the straight line B, the antenna operates as a circularly polarized wave antenna.

In a patch antenna in which a radiation electrode is formed in a substantially rectangular shape, the patch antenna resonates with respect to radio waves having a polarization plane along a long side direction of the radiation electrode and also having a wavelength twice the length of the long side. Likewise, the patch antenna resonates with respect to radio waves having a polarization plane along a short side direction of the radiation electrode and also having a wavelength twice the length of the short side. Therefore, the patch antenna may radiate or receive radio waves having a polarization plane along a long side of the radiation electrode and also having a wavelength twice the length of the long side, and radio waves having a polarization plane along a short side of the radiation electrode and also having a wavelength twice the length of the short side.

Meanwhile, in some applications, such as radar, a patch antenna is required to radiate or receive radio waves having a polarization plane in a specific direction, and to suppress radiation or reception of radio waves having a polarization plane in the other direction. In such a case, in each technology described above, since a slit or a cutout portion is formed at each of four sides of the radiation electrode, it is difficult to radiate or receive radio waves having a polarization plane in a specific direction, and difficult to suppress radiation or reception of radio waves having a polarization planes in the other direction.

The followings are reference documents.

[Document 1] Japanese Laid-Open Patent Publication No. 5-304413,

[Document 2] Japanese Laid-Open Patent Publication No. 2005-203873, and

[Document 3] Japanese Laid-Open Patent Publication No. 2005-252585.

SUMMARY

According to an aspect of the invention, a patch antenna includes:

a substrate configured with a dielectric material; a ground electrode formed on one side surface of the substrate; and a radiation electrode having a rectangular shape formed on another side surface of the substrate, wherein a slit is formed in the radiation electrode in parallel to a first side of the radiation electrode to be shorter than the first side, and each of a gap between the slit and the first side and a gap between the slit and a second side facing the first side is shorter than the first side.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Hereinafter, a patch antenna will be described with reference to the accompanying drawings. The patch antenna includes a ground electrode provided on one side surface of a substrate formed of a dielectric material, and a rectangular radiation electrode provided on the other side surface of the substrate. A slit is formed at one of two sides which are adjacent to a first side and have substantially the same length as the length of the first side, among respective sides of the radiation electrode, in parallel to the first side, in which the length of the first side is ½ of a wavelength to be used. Therefore, a gap between a slit and each of the first side and a second side facing the first side of the radiation electrode becomes shorter than the length of the first side. Accordingly, the patch antenna suppresses resonance with respect to radio waves having a wavelength to be used, in a direction perpendicular to the first side, and suppresses radiation or reception of radio waves having a polarization plane along the direction perpendicular to the first side and having a wavelength to be used. Hereinafter, for convenience of explanation, a wavelength of a radio wave used by the patch antenna, that is, a wavelength of a radio wave to be radiated or received by the patch antenna, is called a design wavelength.

Figure 1:
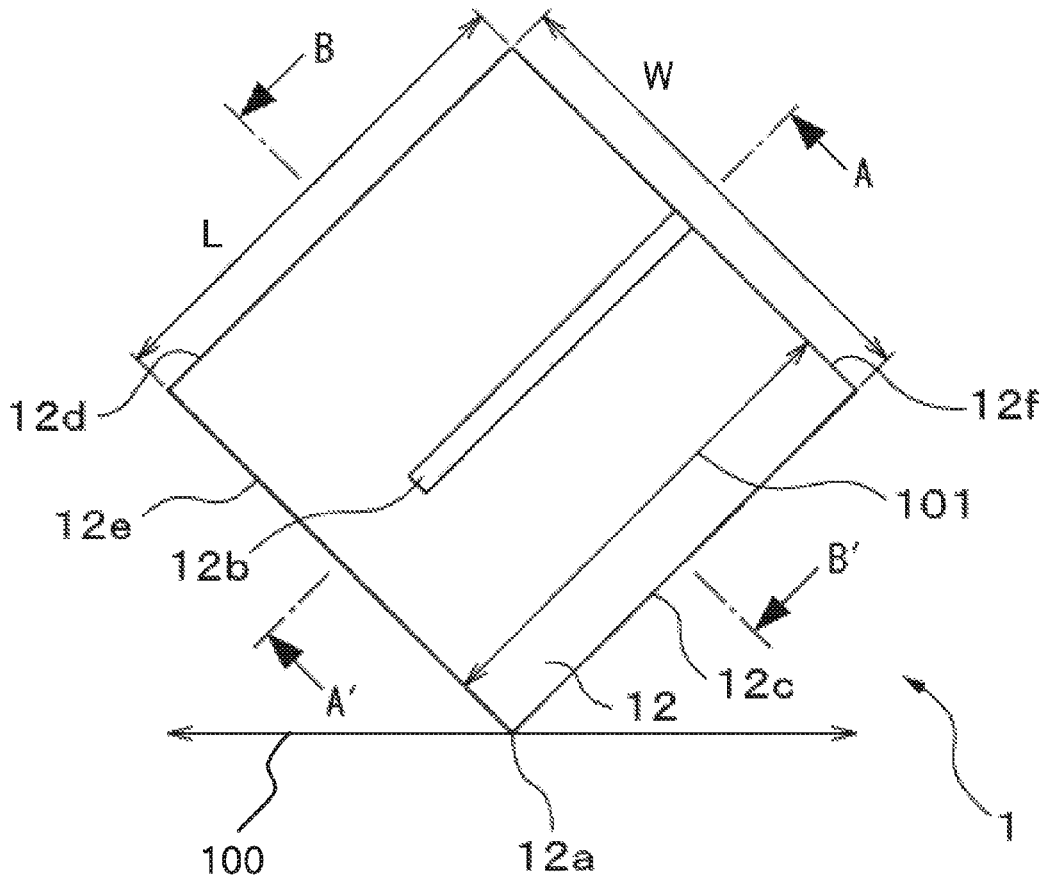
FIG. 1 is a schematic plan view of a patch antenna according to one exemplary embodiment.
Figure 2A:
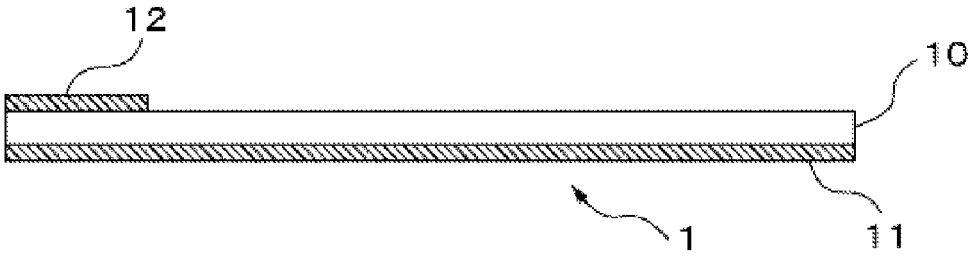
FIG. 2A is a schematic side-sectional view of the patch antenna when a line along AA' of FIG. 1 is viewed from an arrow side.
Figure 2B:
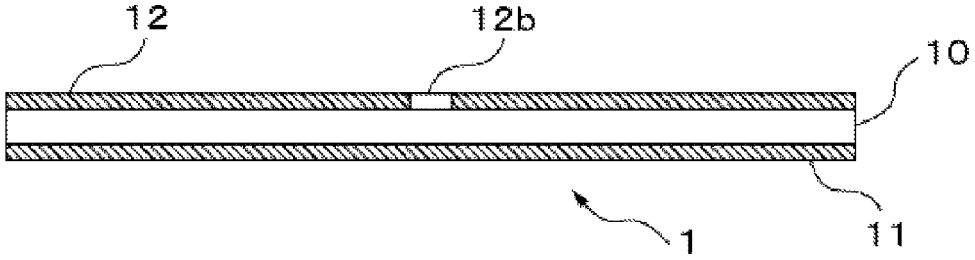
FIG. 2B is a schematic side-sectional view of the patch antenna when a line along BB' of FIG. 1 is viewed from an arrow side.

FIG. 1 is a schematic plan view of a patch antenna 1 according to one exemplary embodiment. FIG. 2A is a schematic side-sectional view of the patch antenna 1 when the line along AA' of FIG. 1 is viewed from the arrow side. FIG. 2B is a schematic side-sectional view of the patch antenna 1 when the line along BB' of FIG. 1 is viewed from the arrow side. Meanwhile, in FIG. 1, and FIGS. 2A and 2B, it should be noted that in order to facilitate the understanding of the structure of the patch antenna 1, a specific part of the patch antenna 1 is emphasized, and sizes of respective units of the patch antenna 1 illustrated in the drawings are different from actual sizes.

The patch antenna 1 includes a substrate 10, a ground electrode 11 provided on one side surface of the substrate 10, and a radiation electrode 12 provided on the other side surface of the substrate 10. The patch antenna 1 is, for example, an antenna for radar, and is used to radiate or receive millimeter waves. Therefore, the patch antenna 1 is disposed such that a normal of the surface of the radiation electrode 12 is parallel to, for example, the ground, and also, each side of the radiation electrode forms an angle of 45° with respect to the ground indicated by the arrow 100 in FIG. 1. Accordingly, the patch antenna 1 may radiate or receive radio waves having a polarization plane forming an angle of 45° with respect to the ground.

The substrate 10 supports the ground electrode 11 and the radiation electrode 12. The substrate 10 is formed of a dielectric material, and thus, the ground electrode 11 and the radiation electrode 12 are insulated from each other. For example, the substrate 10 is formed of a polyimide or a glass epoxy resin such as FR-4. Alternatively, the substrate 10 may be formed of another dielectric material which may be formed in layers.

The ground electrode 11 is a grounded flat plate-like conductor, and is provided to cover one side surface of the substrate 10 (e.g., the bottom side surface of the substrate 10 in FIGS. 2A and 2B) in its entirety.

The radiation electrode 12 is provided in substantially parallel to the ground electrode 11 on a surface of the substrate 10 which is opposite to the surface provided with the ground electrode 11 (e.g., on the top side surface of the substrate 10 in FIGS. 2A and 2B), such that the radiation electrode 12 faces the ground electrode 11 across the substrate 10. In the present exemplary embodiment, the radiation electrode 12 is formed to cover the top side surface of the substrate 10 in its entirety except for the portion formed with a slit 12*b*. Meanwhile, the size of the substrate 10 and the ground electrode 11 when the patch antenna 1 is viewed from the top side is substantially the same as that of the radiation electrode 12. However, the patch antenna 1 may be formed such that when the patch antenna 1 is viewed from the top side, the size of the substrate 10 and the ground electrode 11 is larger than that of the radiation electrode 12, and the ground electrode 11 includes the entire radiation electrode 12.

The radiation electrode 12 receives a signal having a radio frequency corresponding to a design wavelength from a signal processing circuit (not illustrated), through a feed line (not illustrated) connected to a feeding point 12*a* formed at a corner between a side 12*c* and a side 12*e* of the radiation electrode 12. The radiation electrode 12 radiates the signal as radio waves into the air. Alternatively, the radiation electrode 12 receives radio waves having the radio frequency, and passes the received radio waves to the signal processing circuit, as an electrical signal, through the feed line. Meanwhile, the position of the feeding point 12*a* is not limited to the position illustrated in this example, but may be provided at any position of the radiation electrode 12.

In the present exemplary embodiment, the ground electrode 11 and the radiation electrode 12 are formed in rectangular shapes. The radiation electrode 12 is formed such that the length of each of the side 12*c* and a side 12*d* facing the side 12*c* in the radiation electrode 12 is a half of the design wavelength. Therefore, the patch antenna 1 resonates with respect to radio waves having a design wavelength along the side 12*c* and the side 12*d*. Accordingly, the patch antenna 1 may radiate or receive radio waves having a polarization plane along the side 12*c* and the side 12*d*, and also having a design wavelength, as indicated by an arrow 101 in FIG. 1. Meanwhile, it should be noted that according to a relative dielectric constant of the substrate 10, the design wavelength of the radio waves on the radiation electrode 12 becomes shorter than the design wavelength in the air.

Hereinafter, for convenience of explanation, the size of the radiation electrode 12 along the direction of the polarization plane to be used, that is, the length of the side 12*c* and the side 12*d* is expressed as a length L of the radiation electrode. Meanwhile, the size of the radiation electrode in the direction perpendicular to the direction of the polarization plane to be used, that is, the length of the side 12*e* and a side 12*f* positioned in a direction perpendicular to the side 12*c* and the side 12*d*, is expressed as a width W of the radiation electrode 12.

The width W of the radiation electrode 12 may be shorter than the length L of the radiation electrode, or the width W of the radiation electrode 12 may be longer than the length L of the radiation electrode. As the width W of the radiation electrode 12 becomes wider, the area of the radiation electrode 12 capable of resonating with the radio waves having a polarization plane along the side 12*c* and the side 12*d* and also having a design wavelength, becomes wider. Thus, an antenna gain of the patch antenna 1 is improved in the design wavelength. However, when the width W of the radiation electrode 12 becomes longer than the length L of the radiation electrode, the improvement of the antenna gain with respect to the increase of the width W becomes gentle. Therefore, in the present exemplary embodiment, the radiation electrode 12 is formed such that the width W of the radiation electrode 12 becomes substantially the same as the length L of the radiation electrode.

In the radiation electrode 12, a slit 12*b* is formed at a center of any one of the side 12*e* and the side 12*f*, in which the slit 12*b* has one end present at the corresponding side, is parallel to the side 12*c* and is shorter than the length L of the radiation electrode 12. Accordingly, in the direction along the side 12*e* and the side 12*f* of the radiation electrode 12, the length of the portion where the radiation electrode 12 is continuous becomes smaller than ½ of the design wavelength. Therefore, in the direction along the side 12*e* and the side 12*f*, the resonance with respect to the radio waves having a design wavelength is suppressed.

In the present exemplary embodiment, the slit 12*b* is formed such that one end of the slit 12*b* is present at the center of the side 12*f* farther from the feeding point 12*a*, among the side 12*e* and the side 12*f*. Accordingly, in the radiation electrode 12, a current path between the feeding point 12*a*, and a portion connected from the feeding point 12*a* through a portion between the other end of the slit 12*b* and the side 12*e*, becomes short, and thus, a decrease of the antenna gain is suppressed.

The width of the slit 12*b* (that is, the length of the slit 12*b* in the direction parallel to the side 12*f*) may be designed such that two portions of the radiation electrode 12, which face each other across the slit 12*b*, are insulated by the slit 12*b*. Accordingly, the resonance with respect to the radio waves having a design wavelength in the direction along the width W of the radiation electrode 12 is suppressed. Meanwhile, as the width of the slit 12*b* is wider, the area of the radiation electrode 12 capable of resonating with the radio waves having a polarization plane along the side 12*c* of the radiation electrode 12 is shorter. As a result, the antenna gain is reduced. Therefore, the width of the slit 12*b* may be set to, for example, about three times the thickness of the substrate 10.

It is desirable that the length of the slit 12*b* in the direction along the side 12*c* (hereinafter, simply referred to as the length of the slit 12*b*) is longer because the resonance in the direction along the side 12*f* is suppressed. Therefore, the length of the slit 12*b* may be ½ or more of the length in the direction along the side 12*c* of the radiation electrode 12. Accordingly, the area of the radiation electrode 12 capable of resonating in the direction along the side 12*f* becomes ½ or less of the area of the radiation electrode 12 capable of resonating in the direction along the side 12*c*.

However, when the distance of the section between the other end of the slit 12*b* and the side 12*e* becomes too narrow, a current hardly flows in the portion of the radiation electrode 12 connected through the section. Therefore, the distance of the section between the other end of the slit 12*b* and the side 12*e* may be set such that the impedance in the section is not greater than the impedance of the patch antenna 1 (e.g., 50Ω).

In the direction along the side 12*f*, the position where the slit 12*b* is formed is not limited to the center of the side 12*f*. The slit 12*b* only has to be formed at a position where a gap from the slit 12*b* to the side 12*c* and a gap from the slit 12*b* to the side 12*d* is smaller than ½ of the design wavelength. However, as any one of the gap from the slit 12*b* to the side 12*c* and the gap from the slit 12*b* to the side 12*d* reaches ½ of the design wavelength, the antenna gain of the patch antenna 1 is improved with respect to radio waves having a polarization plane along the side 12*f*, and a design wavelength. Therefore, the slit 12*b* may be formed at the center of the side 12*f* such that both the gap from the slit 12*b* to the side 12*c* and the gap from the slit 12*b* to the side 12*d* are sufficiently smaller than ½ of the design wavelength.

Meanwhile, the ground electrode 11 and the radiation electrode 12 are formed of, for example, metals such as copper, gold, silver, nickel or alloys thereof, or other conductive materials.

Hereinafter, a simulation result of a radiation characteristic of the patch antenna 1 will be described. In this simulation, a moment method was used. Also, in the following simulation, it was assumed that the patch antenna 1 and a patch antenna of Comparative Example were used at a frequency ranging from 76 GHz to 81 GHz.

Figure 3A:
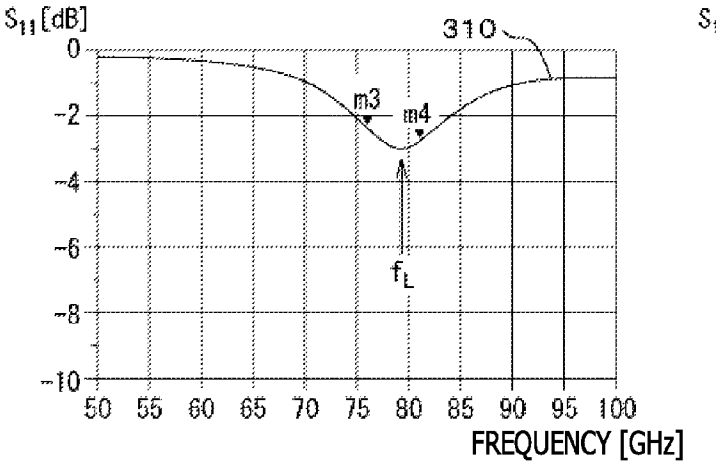
FIGS. 3A to 3C are views illustrating simulation results of an $S_{11}$ parameter when radiation electrodes have difference widths, respectively, in a patch antenna of Comparative Example which has a radiation electrode not formed with a slit.
Figure 3B:
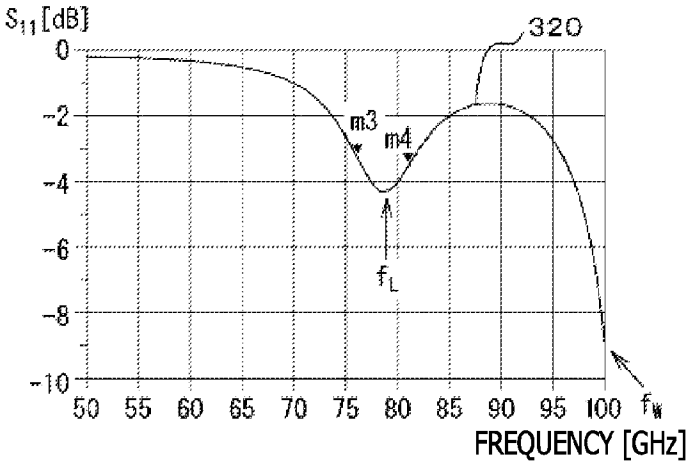
Figure 3C:
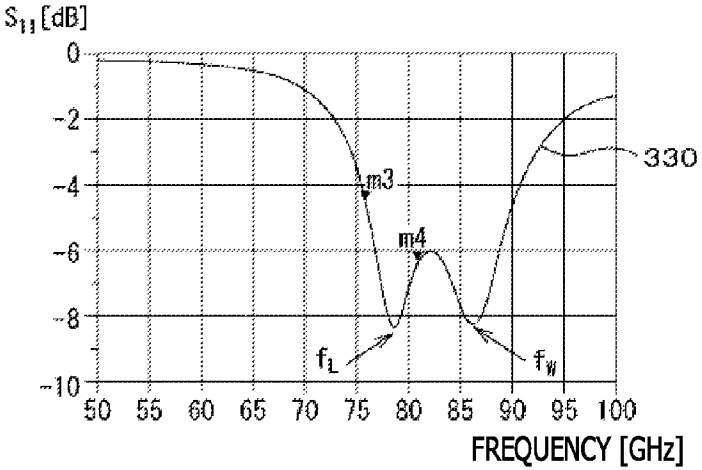

FIGS. 3A to 3C are views illustrating simulation results of an $S_{11}$ parameter when radiation electrodes have different widths W, respectively, in a patch antenna of Comparative Example which is configured in the same manner as in the patch antenna 1 except that a slit is not formed in the radiation electrode. In this simulation, the thickness of the substrate was set to 50 μm, the relative dielectric constant $\epsilon_r$ was set to 3.4, and a dielectric loss tangent tan δ was set to 0.01. Also, it was assumed that the radiation electrode and the ground electrode were formed of a metal having a conductivity $\sigma=4.1\times10^7$ S/m, and the thickness of the radiation electrode and the ground electrode was set to 5 μm. In FIGS. 3A to 3C, the horizontal axis represents a frequency [GHz], and the vertical axis represents an $S_{11}$ parameter [dB]. In FIGS. 3A to 3C, m3 represents a frequency of 76 GHz, and m4 represents a frequency of 81 GHz.

FIG. 3A illustrates a simulation result of an $S_{11}$ parameter when a length L of a radiation electrode is 1100 μm, and a width W is 400 μm. A graph 310 indicates a relationship between a frequency and an $S_{11}$ parameter. In this example, since the width W of the radiation electrode is not greater than ½ of the length L of the radiation electrode, an area of the radiation electrode capable of resonating with respect to radio waves at a frequency ranging from 76 GHz to 81 GHz in which a desired frequency fL corresponding to the length L is included is small. Therefore, at a frequency ranging from 76 GHz to 81 GHz, the $S_{11}$ parameter becomes relatively high.

FIG. 3B illustrates a simulation result of an $S_{11}$ parameter when a length L of a radiation electrode is 1100 μm, and a width W is 700 μm. A graph 320 indicates a relationship between a frequency and an $S_{11}$ parameter. In this example, since the width W of the radiation electrode is wider than that of the example illustrated in FIG. 3A, the $S_{11}$ parameter is decreased at a frequency ranging from 76 GHz to 81 GHz. Also, as the width W is widened, the difference between a frequency fW corresponding to twice the width W and a frequency fL, where the $S_{11}$ parameter has relative minimal values, is decreased.

FIG. 3C illustrates a simulation result of an $S_{11}$ parameter when a length L of a radiation electrode is 1100 μm, and a width W is 1000 μm. A graph 330 indicates a relationship between a frequency and an $S_{11}$ parameter. In this example, since the width W of the radiation electrode is wider than that of the example illustrated in FIG. 3B, the $S_{11}$ parameter is decreased at a frequency ranging from 76 GHz to 81 GHz. Also, since the difference between the length L and the width W is further decreased, the difference between a frequency fL and a frequency fW, where the $S_{11}$ parameter has relative minimal values, is further decreased. Then, since the difference between the frequency fL and the frequency fW is small, it may be found that the patch antenna in Comparative Example is capable of radiating or receiving, at the frequency fL, not only radio waves having a polarization plane along a side corresponding to the length L, but also radio waves having a polarization plane along a side corresponding to the width W. Accordingly, this patch antenna in Comparative Example is not suitable for applications where the patch antenna is required to radiate or receive radio waves having a polarization plane in a specific direction, and required to suppress radiation or reception of radio waves having a polarization plane in the other direction.

Figure 4:
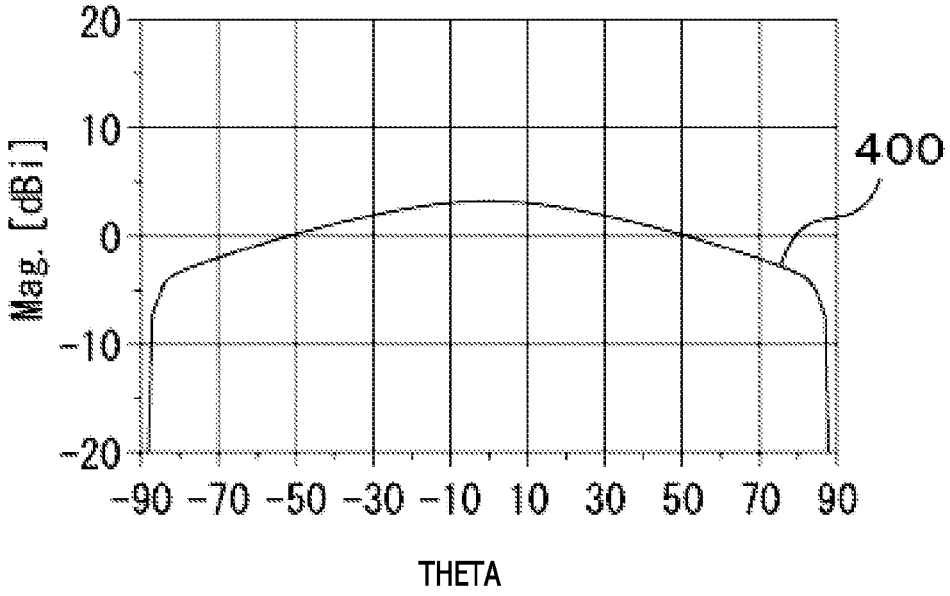
FIG. 4 is a view illustrating an antenna gain in a patch antenna of Comparative Example.

FIG. 4 is a view illustrating an antenna gain at a frequency fL in a patch antenna of Comparative Example when a length L of a radiation electrode is 1100 μm, and a width W is 700 μm as in the example illustrated in FIG. 3B. In FIG. 4, the horizontal axis represents an angle (θ) formed along the direction indicated by the arrow 100 of FIG. 1, with respect to the normal at the center on the surface of the radiation electrode. The vertical axis represents an antenna gain [dBi]. Then, a graph 400 represents a relationship between the angle (θ) and the antenna gain. In this example, the antenna gain becomes the highest in the normal direction, that is, the antenna gain becomes 3.076 [dBi].

Figure 5A:
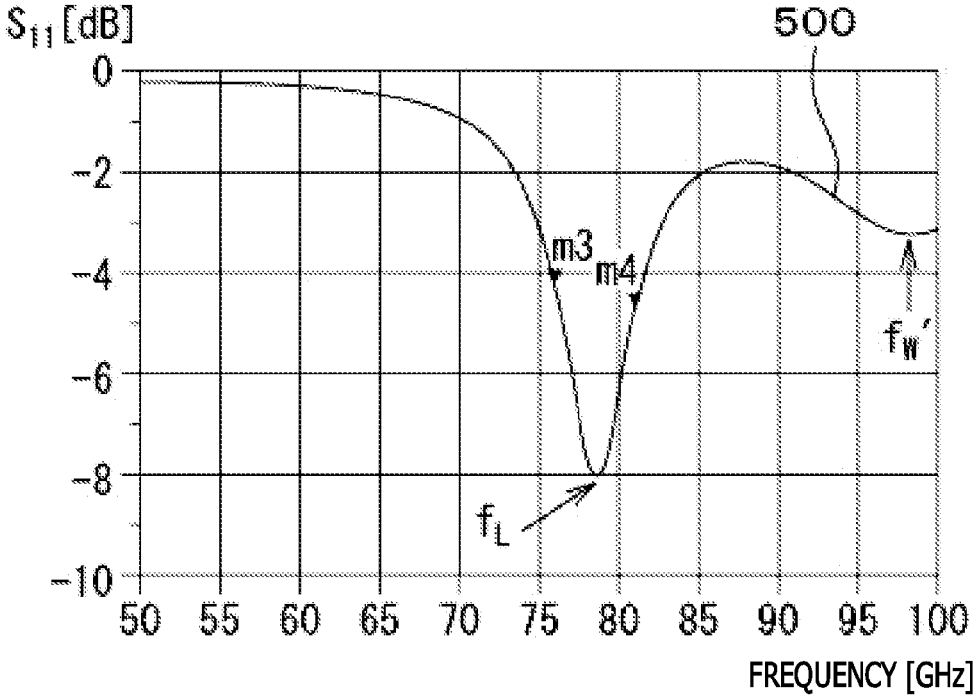
FIG. 5A is a view illustrating a simulation result of an $S_{11}$ parameter in a patch antenna according to one exemplary embodiment.

FIG. 5A is a view illustrating a simulation result of an $S_{11}$ parameter in the patch antenna 1 according to one exemplary embodiment. In FIG. 5A, the horizontal axis represents a frequency [GHz], and the vertical axis represents an $S_{11}$ parameter [dB]. In FIG. 5 as well, m3 represents a frequency of 76 GHz, and m4 represents a frequency of 81 GHz. A graph 500 indicates a relationship between a frequency and an $S_{11}$ parameter for the patch antenna 1. Meanwhile, in this example, each of a length L and a width W of the radiation electrode 12 was set to 1100 μm. Also, a width of a slit was set to 14.1 μm, and a length of the slit was set to 874.2 μm.

As indicated in the graph 500, the value of the $S_{11}$ parameter at the frequency ranging from 76 GHz to 81 GHz becomes almost the same as that of the patch antenna of Comparative Example in a case where the width W of the radiation electrode was set to 1000 μm. In the present exemplary embodiment, the resonance along the direction corresponding to the width W is suppressed by the slit 12*b*, while the $S_{11}$ parameter has a relative minimal value at a frequency fW' corresponding to the gap between the slit 12*b* and the side 12*c* or the side 12*d*, that is, a half of the width W. However, in this case, a difference between the frequency fW' and the frequency fL becomes larger than the difference between the frequency fL and the frequency fW in the patch antenna of Comparative Example in a case where the width W of the radiation electrode was set to 1000 μm. Accordingly, it may be found that at the frequency fL, that is, at the design wavelength, the patch antenna 1 may suppress radiation or reception of radio waves having a polarization plane along the direction corresponding to the width W.

Figure 5B:
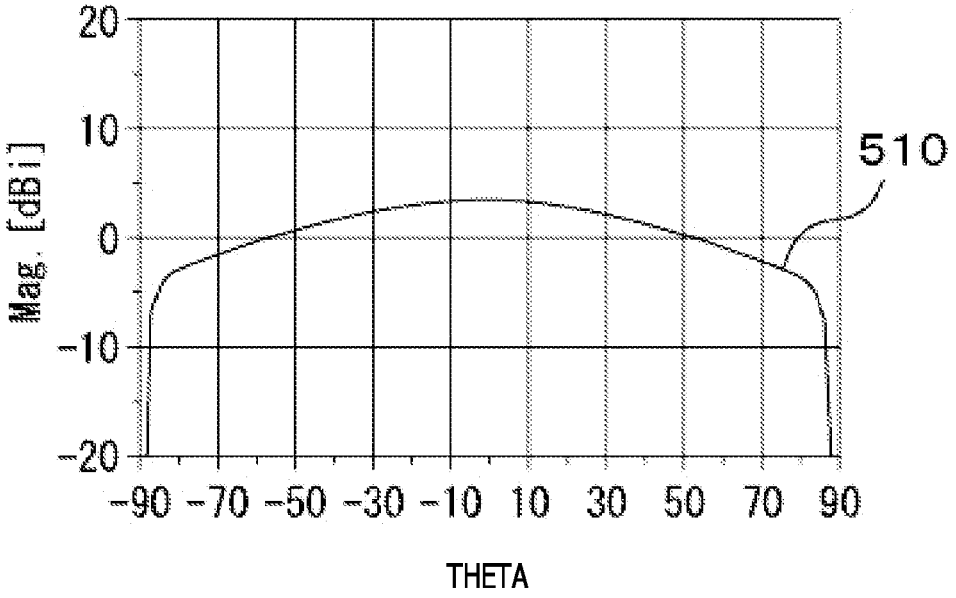
FIG. 5B is a view illustrating a simulation result of an antenna gain in a patch antenna according to one exemplary embodiment.

FIG. 5B is a view illustrating an antenna gain at a frequency fL in the patch antenna 1 according to the present exemplary embodiment. Meanwhile, in this example as well, each of a length L and a width W of the radiation electrode 12 was set to 1100 μm. In FIGS. 5A and 5B, the horizontal axis represents an angle (θ) formed along the direction indicated by the arrow 100 of FIG. 1, with respect to the normal at the center on the surface of the radiation electrode 12. The vertical axis represents an antenna gain [dBi]. Then, a graph 510 represents a relationship between the angle (θ) and the antenna gain. In this example, it may be found that the antenna gain becomes 3.634[dBi] in the normal direction and is improved as compared to that in Comparative Example where the width W of the radiation electrode is 700 μm.

As described above, in the patch antenna, since a slit parallel to a direction of a polarization plane to be used is formed in the rectangular radiation electrode, at a side in a direction perpendicular to a direction of the polarization plane to be used, the resonance in the direction perpendicular to the polarization plane to be used is suppressed. Accordingly, in the patch antenna, the side in the direction perpendicular to the polarization plane to be used is lengthened so that the antenna gain is improved, and radio waves having a polarization plane in the direction perpendicular to the polarization plane to be used may be suppressed from being radiated or received.

Figure 6A:
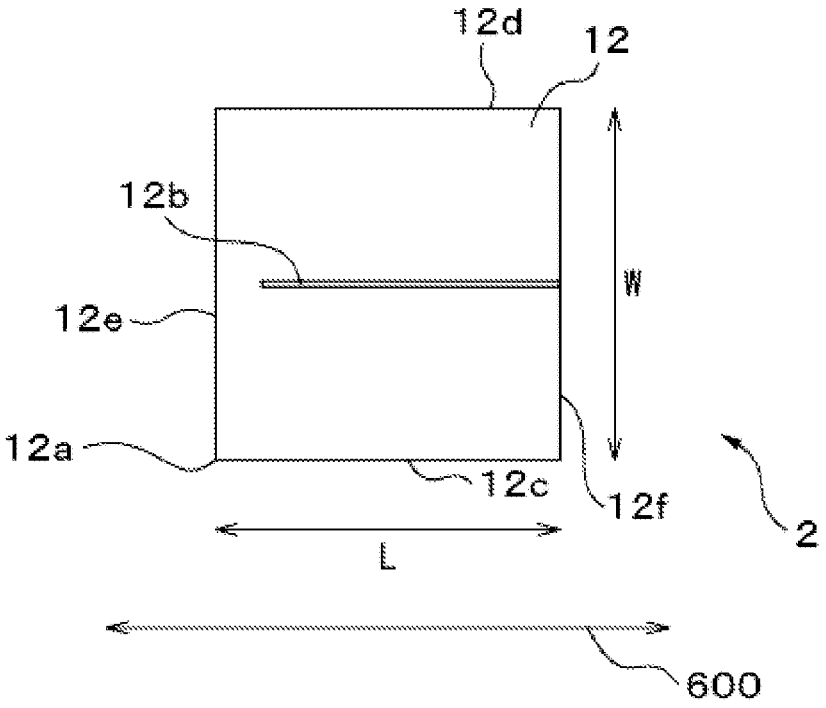
FIGS. 6A and 6B are schematic plan views of patch antennas according to modified examples, respectively.
Figure 6B:
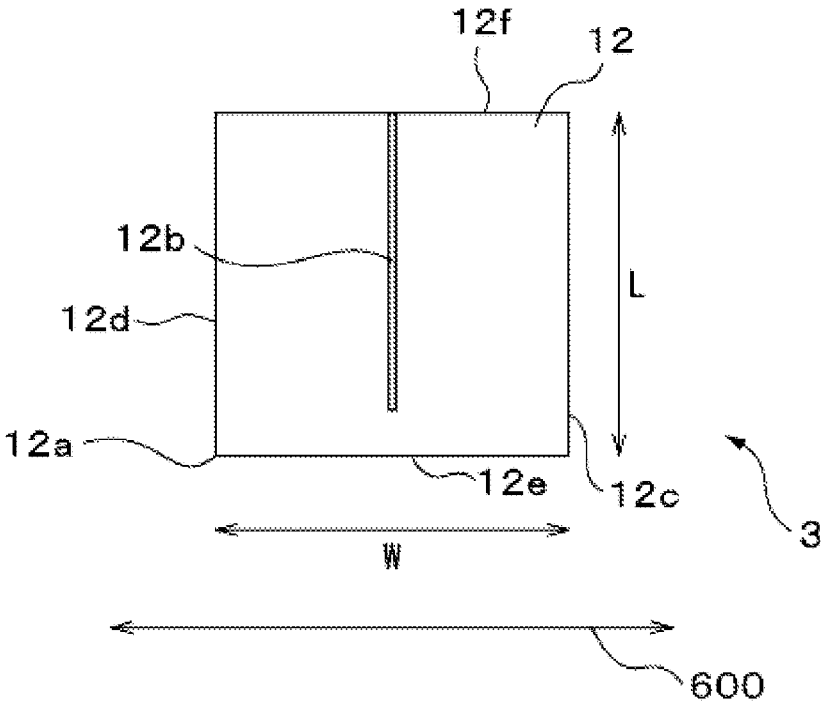

Meanwhile, the shape, the arrangement, and the number of the radiation electrodes which the patch antenna may have are not limited to the exemplary embodiment described above. FIGS. 6A and 6B are schematic plan views of patch antennas according to modified examples, respectively. Meanwhile, in FIGS. 6A and 6B, an arrow 600 indicates a direction parallel to the ground.

A patch antenna 2 according to a modified example illustrated in FIG. 6A, is different from the patch antenna 1 illustrated in FIG. 1 in the arrangement relative to the ground. That is, in the patch antenna 2, a side 12*c* and a side 12*d* of a radiation electrode 12 parallel to a direction of a polarization plane to be used are arranged in parallel to the ground. Meanwhile, a slit 12*b* parallel to the side 12*c* is formed at the center of a side 12*f* farther from a feeding point 12*a*, among a side 12*e* and the side 12*f* in a direction perpendicular to the ground. Then, the radiation electrode 12 is formed such that the width W of the side 12*e* and the side 12*f* becomes substantially the same as the length L of the side 12*c* and the side 12*d*. Accordingly, the patch antenna 2 may radiate or receive radio waves having a design wavelength corresponding to twice the length L of the side 12*c* and also having a polarization plane in a direction parallel to the ground.

A patch antenna 3 according to a modified example illustrated in FIG. 6B, is different from the patch antenna 1 illustrated in FIG. 1 in the arrangement relative to the ground. That is, in the patch antenna 3, a side 12*c* and a side 12*d* of a radiation electrode 12 parallel to a direction of a polarization plane to be used are arranged to be perpendicular to the ground. Meanwhile, a slit 12*b* parallel to the side 12*c* is formed at the center of a side 12*f* farther from a feeding point 12*a*, among a side 12*e* and the side 12*f* of the radiation electrode 12 in a direction parallel to the ground. Then, the radiation electrode 12 is formed such that the width W of the side 12*f* becomes substantially the same as the length L of the side 12*c*. Accordingly, the patch antenna 3 may radiate or receive radio waves having a design wavelength corresponding to twice the length L of the side 12*c* and also having a polarization plane in a direction perpendicular to the ground.

Figure 7:
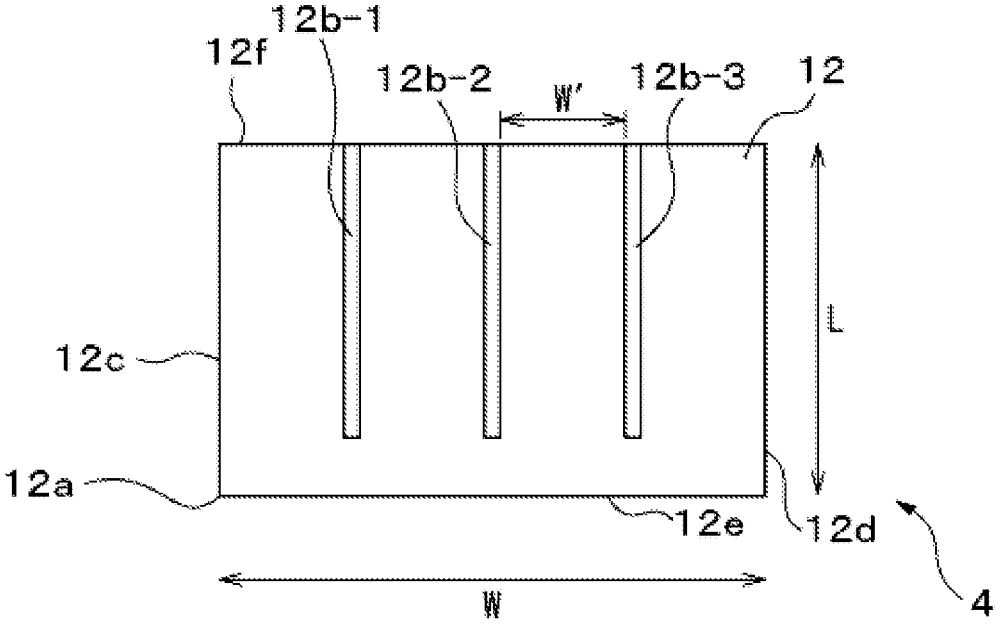
FIG. 7 is a schematic plan view of a patch antenna according to another modified example.

FIG. 7 is a schematic plan view of a patch antenna according to another modified example. In a patch antenna 4 according to the modified example, a width W of a radiation electrode 12 in a direction perpendicular to a polarization plane to be used, that is, a length of a side 12*f*, is set to be longer than the length L of the radiation electrode 12 in a direction parallel to the polarization plane to be used, that is, the length of the side 12*c*. Meanwhile, in this example, the width W is substantially 1.5 times the length L.

A plurality of slits 12*b*-1 to 12*b*-3 parallel to the side 12*c* are formed at equal intervals at the side 12*f* farther from a feeding point 12*a* among a side 12*e* and the side 12*f*. Therefore, a width W' between adjacent slits is set to be shorter than the length L. Accordingly, in this example as well, the resonance with respect to radio waves having a design wavelength in the direction perpendicular to the polarization plane to be used is suppressed. Also, in this example, the width W' between adjacent slits is set to be narrower than the gap between the slit 12*b* and the side 12*c* or side 12*d* of the patch antenna 1 according to the exemplary embodiment described above. Therefore, in the patch antenna 4 according to this modified example, at a frequency fL of radio waves having a design wavelength twice the length L, a more linear polarization properly may be obtained. Also, in this example, since the width W of the radiation electrode 12 may be set to be longer than the length L in a direction parallel to a polarization plane to be used, the antenna gain per one patch antenna is further improved.

According to another modified example, slits may be formed in parallel to a polarization plane to be used, at both sides of two sides in a direction perpendicular to the polarization plane to be used. Otherwise, the slit may be formed in parallel to the polarization plane to be used, at the center of the radiation electrode, and both ends of the slit may not be connected to any side of the radiation electrode.

According to a further modified example, in the position of a radiation electrode where a slit is formed, the slit may also be formed at a substrate and a ground electrode. In this modified example as well, the same effect as that in the patch antenna according to the exemplary embodiment described above may be obtained.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A patch antenna, comprising:

a substrate configured with a dielectric material;

a ground electrode formed on a first surface of the substrate;

a radiation electrode having a rectangular shape formed in parallel to the ground electrode on a second surface of the substrate that is opposite to the first surface; and a slit formed in linear shape from an edge portion of a first side of the radiation electrode toward a center portion of the radiation electrode, wherein the slit is formed in parallel to a second side that is perpendicular to the first side and made shorter than the second side, each between the slit and the second side and a gap between the slit and a third side facing the second side is shorter than the second side, and a length of the first side of the radiation electrode is ½ of a wavelength of received radio waves.

2. The patch antenna according to claim 1, further comprising:

a feeding point formed at one corner of the radiation electrode, wherein the slit is formed such that one end of the slit is located on a side farther from the feeding point, between two sides perpendicular to the second side of the radiation electrode.

3. The patch antenna according to claim 1, wherein a length of the second side of the radiation electrode is ½ of a wavelength of received radio waves.

4. The patch antenna according to claim 1, wherein a length of the slit is ½ or more of a length of each of the first side and the second side.

5. The patch antenna according to claim 1, wherein the radiation electrode is formed such that a length of each of two sides of the radiation electrode perpendicular to the second side is longer than a length of the first side.

6. The patch antenna according to claim 5, further comprising:

a plurality of slits formed along the two sides, wherein a gap between the adjacent slits is shorter than the second side.

7. The patch antenna according to claim 1, wherein a width of the slit is three times a thickness of the substrate.

* * * * *